United States Patent [19]

Detjen

[11] 4,338,986

[45] * Jul. 13, 1982

[54] LOG HANDLING METHOD AND APPARATUS

[75] Inventor: Robert K. Detjen, Eau Claire, Wis.

[73] Assignee: McDonough Manufacturing Company, Eau Claire, Wis.

[ * ] Notice: The portion of the term of this patent subsequent to Mar. 1, 1994, has been disclaimed.

[21] Appl. No.: 116,065

[22] Filed: Jan. 28, 1980

Related U.S. Application Data

[60] Continuation of Ser. No. 956,519, Oct. 31, 1978, Pat. No. 4,206,673, which is a division of Ser. No. 772,152, Feb. 25, 1977, Pat. No. 4,146,072, which is a continuation-in-part of Ser. No. 556,836, Mar. 10, 1975, Pat. No. 4,009,632.

[51] Int. Cl.[3] ..... B27B 15/08; B27B 29/08; B27C 1/12; B27C 9/00

[52] U.S. Cl. ..... 144/39; 83/731; 83/435.2; 83/437; 83/708; 198/620

[58] Field of Search ..... 83/435.2, 708, 425.2, 83/425.3, 437, 731, 730; 144/312, 39; 198/620, 604

[56] References Cited

U.S. PATENT DOCUMENTS

| | | | |
|---|---|---|---|
| 4,009,632 | 3/1977 | Detjen | 83/731 |
| 4,100,950 | 7/1978 | Stearns | 144/242 D |
| 4,146,072 | 3/1979 | Detjen | 144/312 |
| 4,206,673 | 6/1980 | Detjen | 83/731 |
| 4,250,937 | 2/1981 | Detjen | 144/312 |

*Primary Examiner*—Donald R. Schran
*Attorney, Agent, or Firm*—Beveridge, DeGrandi & Kline

[57] ABSTRACT

Logs are advanced substantially in the direction of their longitudinal axes through a saw while engaged between a driven pusher dog and a retarded holdback dog. The pusher dog is on an endless carrier chain located above an initial log support, and the holdback dog is on an endless carrier chain located below the log path and forwardly of the support. Logs on the support are movable angularly and laterally from the machine axis to displaced positions which are unobstructed by the carrier chains, to permit offset sawing and taper sawing. Chipper heads produce planar surfaces on logs approaching the saw. A retractible preliminary holdback dog engages the forward end of a log and moves past a bottom-flattening chipper head to a tranfer area where the chain-carried holdback dog engages the log and the preliminary holdback dog is retracted.

13 Claims, 14 Drawing Figures

FIG.12
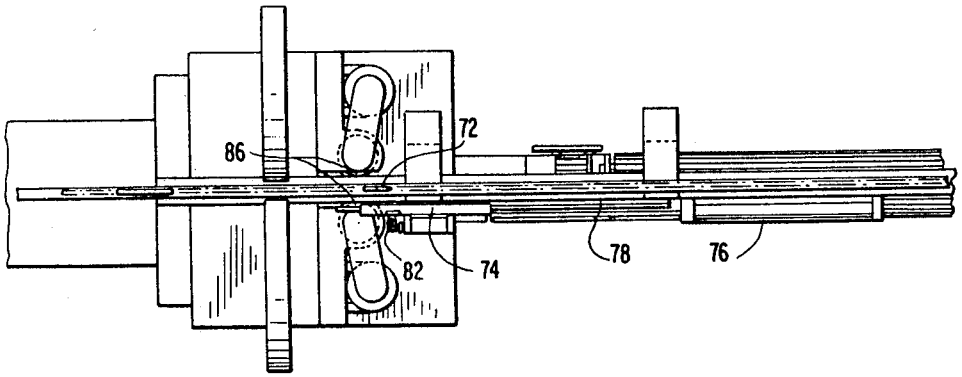
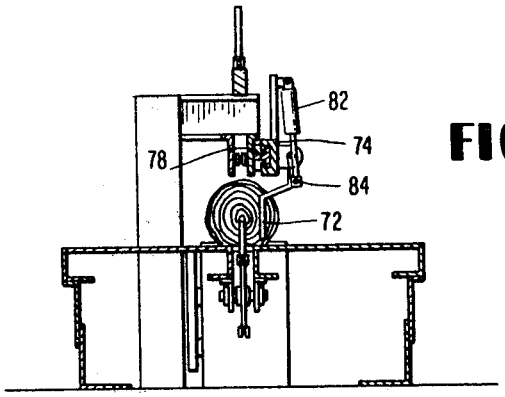
FIG.13
FIG.14
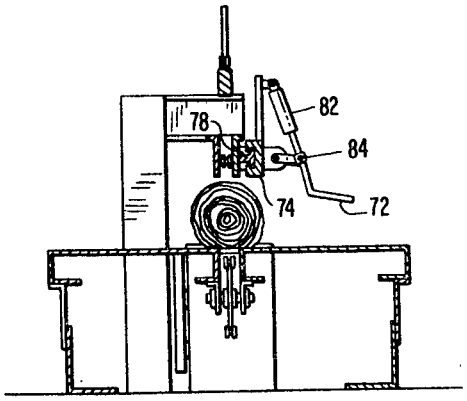

LOG HANDLING METHOD AND APPARATUS

REFERENCE TO RELATED APPLICATIONS

This is a continuation of pending application Ser. No. 956,519, filed Oct. 31, 1978, now U.S. Pat. No. 4,206,673, which in turn was a division of Ser. No. 772,152, filed Feb. 25, 1977, now U.S. Pat. No. 4,146,072 which is a continuation-in-part application of earlier application Ser. No. 556,836 filed Mar. 10, 1975 for Sawmill Log Handling System, U.S. Pat. No. 4,009,632 of Mar. 1, 1977, the entirety of which is incorporated herein by reference.

BACKGROUND AND SUMMARY OF THE INVENTION

This invention relates to improvements in the original log feeding system of U.S. Pat. No. 4,009,632, and to a sawing method which is used both in the original system and the improved apparatus.

Prior to the development of the original log feeding system developed by the present inventor, there had been no uncomplicated and effective commercial systems for engaging logs and advancing them accurately through a saw.

As pointed out in the specification of my earlier application, prior skrag saws were operated by placing a log on a narrow chain provided with pusher dogs for driving the logs through circular saws or opposed band saws. On the outfeed side of such saws, upright guides called "splitters", were positioned in the cut made by the saw blade. Although simple, the use of these systems for accurate sawing was restricted to operation on essentially cylindrical small short logs.

There have been prior systems in which logs of varying lengths could be accurately sawed by engaging their opposite ends with members which apply a gripping force thereto. Such systems are disclosed in U.S. Pat. Nos. 3,503,428 and 3,731,578 to Bo Ingemar Ackerfeldt. Such systems are highly complicated and far more complex and expensive than the original system and improved apparatus of the present inventor. Ackerfeldt suspends the forward and rear log-engaging means from a common overhead track. Both log-engaging means are coupled to and disengagable from a common drive cable, and a spring is used to apply a gripping force between the log-engaging means.

During the prosecution of the original patent application, is was learned that Mead at al U.S. Pat No. 2,332,654 disclosed a system for advancing transversely oriented boards toward a saw by pusher members on a driven chain, while simultaneously imposing a rearward force on the boards by holdback members supported on a frictionally retarded carrier chain. The differences between my original apparatus and the Mead et al. apparatus are claimed in the original patent. The differences between the method of operation of my original and present apparatus and that of the Mead et al patent is the subject of the method claimed herein. The present apparatus also includes a number of improvements which have been developed subsequent to the filing of the patent application on the original system.

A basic principle of operation common both to the original apparatus and the present improved apparatus is the method of operation wherein the rear end of a log is engaged by a rear member driven in a forward direction, and the forward end of the log is engaged by a forward member which is driven forwardly by the moving log but resists such forward movement. This exerts a rearward force on the log, causing the log to be gripped firmly between the forward and rear members as it is advanced substantially along its longitudinal axis through the saw. For convenience of expression, but without limitation to any structure disclosed herein, the forward and rear members will be referred to respectively as holdback dogs and pusher dogs.

This basic principle of operation results in the positive clamping of the log and assures its straight and accurate travel through the saw. It permits any unit to handle logs having a wide range of lengths and, when vertical adjustability of one of the dogs is provided, it permits a unit to handle logs having a wide range of diameters.

An improved feature of the present apparatus is that, prior to engagement by the dogs, the log is located on an initial support which permits or causes the log to be pre-oriented, i.e. moved to displaced positions offset laterally and/or angularly with respect to the machine axis. Taper sawing may be performed when the longitudinal axis of the log is angularly inclined to the machine axis; and, offset sawing results when the longitudinal axis of the log is parallel to and offset laterally from the machine axis. In both instances, it is preferred that the log axis be substantially horizontal and substantially parallel to the machine axis. In this context, "substantially" means within about five degrees of the machine axis.

One structural feature of the improved apparatus which facilitates the pre-orientation of a log is that the holdback dog is supported and mounted on a carrier which lies forwardly of the initial log support and is located below the path of the log moving through the saw. Preferably, this carrier is an endless chain from which the holdback dogs project upwardly while engaging a log. This arrangement also avoids the movement of a dog-carrier between or through the initial log support as in the original apparatus; and, it makes it possible to equip the apparatus with a bottom-flattening chipper head which operates on a log moving toward the saw.

Another improvement over the original apparatus is the simplification which has resulted from shortening the effective path followed by the pusher dogs while engaging a log, thus eliminating a portion of the structure required for supporting and guiding the pusher dogs. This is achieved by supporting and guiding the holdback dogs below the log path, and supporting and guiding the pusher dogs above the log path. In conjunction with this, it is desirable to add rotary driven members for frictionally engaging the sawn logs to move them along the machine axis for discharge.

BRIEF DESCRIPTION OF THE DRAWINGS

FIG. 12 is an elevational view of the apparatus of FIGS. 9–11.

FIGS. 13 and 14 are rearwardly-facing views taken along lines 13—13 and 14—14 in FIGS. 10 and 11, respectively showing the holdback dog in its operative and retracted positions.

THE PREFERRED EMBODIMENTS

Figure 1:
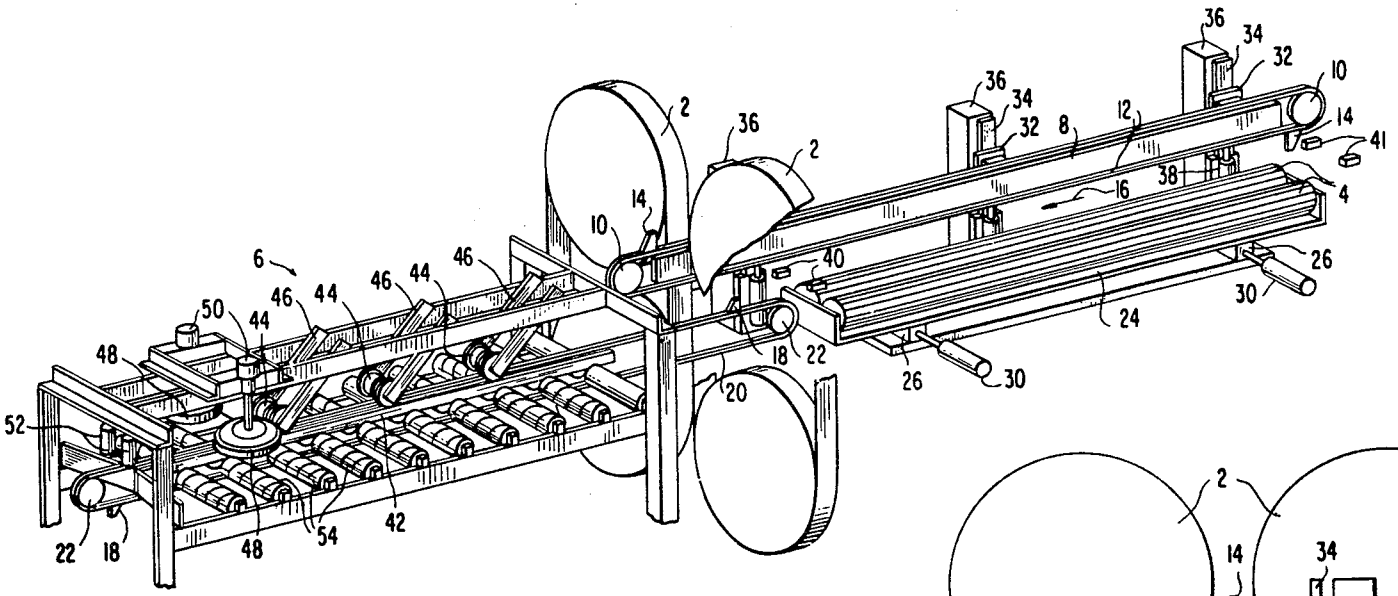
FIG. 1 is a perspective view of an improved apparatus constructed according to the invention.
Figure 4:
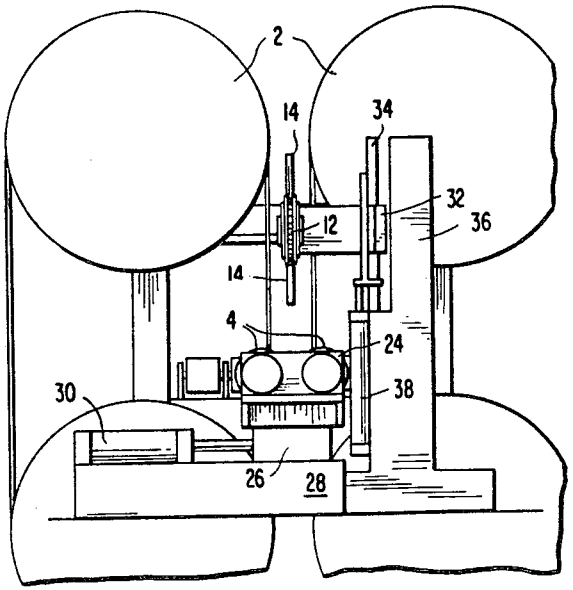
FIG. 4 is an end view of the apparatus as seen along the line 4—4 in FIG. 2.
Figure 2:
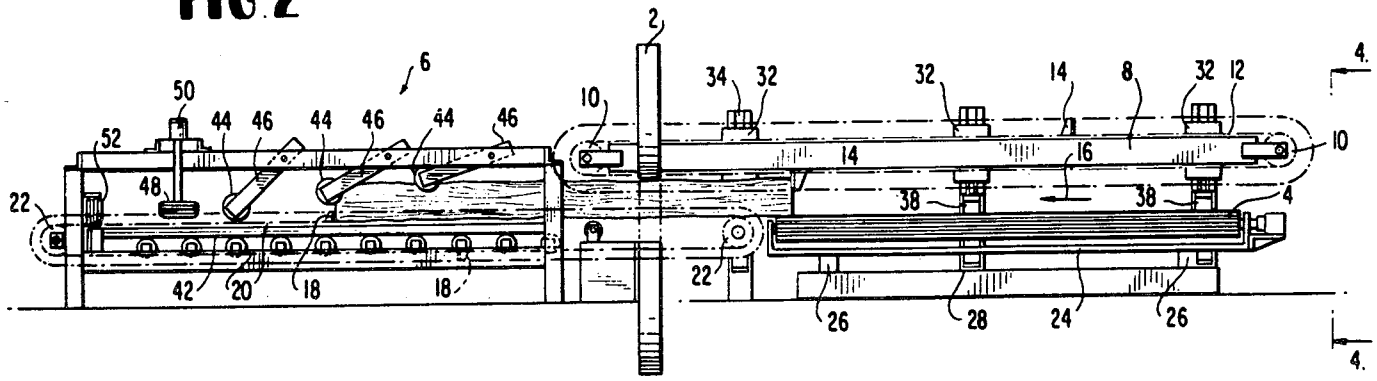
FIG. 2 is a side elevation of the improved apparatus.
Figure 3:
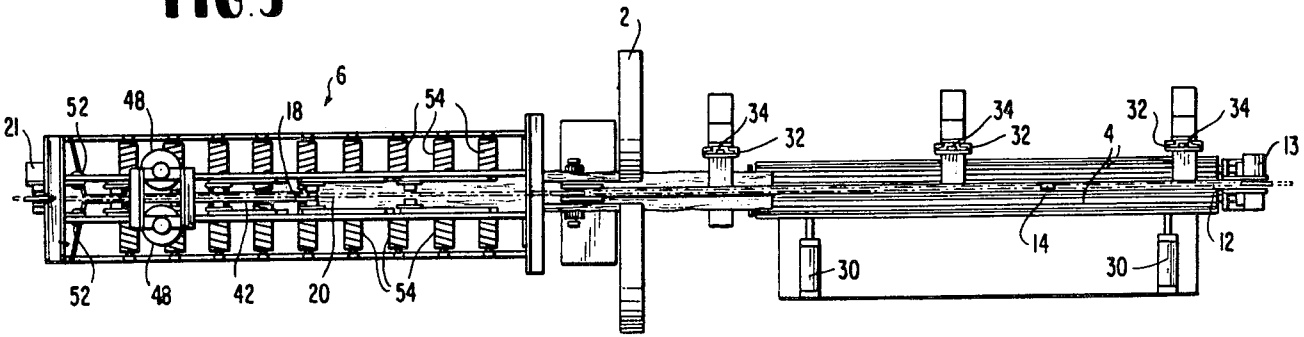
FIG. 3 is a plan view of the apparatus.

FIG. 1 shows twin bandsaw units 2 positioned between log turning and positioning rolls 4 and an outfeed section 6. On the infeed side of the saws and extending a short distance past them, there is a beam 8 provided with sprockets 10 at its opposite ends. A chain 12 engages the sprockets 10 and carries a pair of pusher dogs 14 which serve as the rear log-engaging means of the apparatus. One of the sprockets 10 is connected to a hydraulic drive motor which advances the chain 12 in a direction causing the pusher dogs 14 to move forwardly along the machine axis in the direction of arrow 16.

As a log is moved forwardly by the pusher dogs 14, the forward end of each log is engaged by one of the holdback dogs 18 which serve as the forward log-engaging means. The holdback dogs 18 are affixed to a carrier chain 20 located below the log path. Sprockets 22 locate and support the upper effective run of the chain 20 parallel to the machine axis. An hydraulic motor is connected to one of the sprockets 22 and is normally inactive during sawing operations to impose a drag or resistive force on the movement of chain 20, thus causing the holdback dogs 18 to exert a rearward force on the forward end of a log being advanced through the saws. This causes firm clamping of the log between a pusher dog 14 and a holdback dog 18 to assure accurate linear movement of the log through the saws 2.

My original apparatus had the capability of firmly engaging and accurately carrying a log through the saws, but it had an inability to saw while the log axis, i.e. the longitudinal centerline of the log, was horizontally displaced from the machine axis. This was because the lower carrier chain extended between the turning rolls. The present apparatus offers a greater selection of log-sawing programs by enabling the log axis to be displaced horizontally from the machine axis. In the preferred embodiment, such displacement is made possible by placing the holdback dogs on a lower carrier chain which is located forwardly of the turning rolls, and supporting the turning rolls on a laterally-shiftable platform.

As seen in FIGS. 1–4, this platform 24 has upstanding end flanges which support the turning rolls, and a horizontal plate overlying and pivotally connected to slide bars 26. The slide bars 26 are slidable on the upper surface of a stationary base plate 28. Displacement of the platform 24 and the turning rolls 4 is produced by actuation of either or both of the hydraulic cylinders 30.

So that the apparatus of FIGS. 1–4 may operate on logs having a wide range of diameters, the beam 8 is vertically adjustable. The beam 8 is supported on slide blocks 32 having grooves which engage the vertical tracks 34 on the stationary upright pedestals 36. Each of the hydraulic cylinders 38 has a stationary lower end and a vertical rod which is connected to one of the slide blocks 32. An operator actuating the cylinders 38 may raise and lower the beam 8 so that the pusher dogs 14 will be at an elevation appropriate for engaging the rear end surfaces on logs having a wide range of diameters.

Various techniques may be used for determining the most suitable position of a log prior to engagement by the pusher dog 14. Electronic scanners may be used to select the optimum position, or this may be done according to the judgement of an experienced operator. In the latter case, the operator may be assisted by providing small stationary light beam projectors 40 and 41. Each of these projectors projects a light beam in a direction parallel to the machine axis, the forward projectors 40 directing the beams in a rearward direction and the rear projectors 41 directing their beams in a forward direction. The beams will strike and form spots of light on the forward and rear end surfaces of a log positioned on the turning rolls 4. After the log has been positioned by reference to the spots of light, the forward projectors 40 are retracted to remove them from the path of a log moving toward the saws 2.

On the outfeed side of the saws 2, there is a center beam 42 for supporting the sawn cant. The cant is stabilized on the beam 42 by the flanged support rolls 44 located on the lower ends of swinging arms 46. The cant eventually comes into contact with the support tires 48 which are rotated by the hydraulic motors 50. The external surfaces of the support tires 48 frictionally engage the sides of the cant and drive it forwardly into the driven clearing rolls 52 to discharge the cant longitudinally from the apparatus. Any slabs or sideboards removed by the saws 2 are permitted to fall onto the screw rolls 54, the latter being positively rotated in a well-known manner to discharge the slabs or sideboards from the apparatus in a lateral direction. After a log has passed the saw, the drive motor for chain 20 is activated to accelerate a dog forwardly from the log and advance the chain to bring the other holdback dog 18 to a ready position in the path of the next incoming log.

Figure 5:
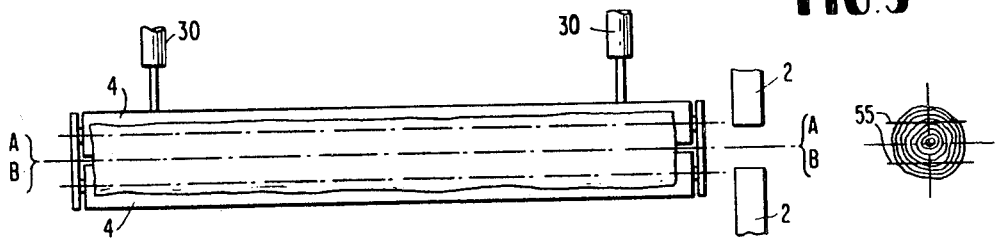
FIG. 5 illustrates diagramatically the apparatus of FIGS. 1–4 when used for center sawing.
Figure 6:
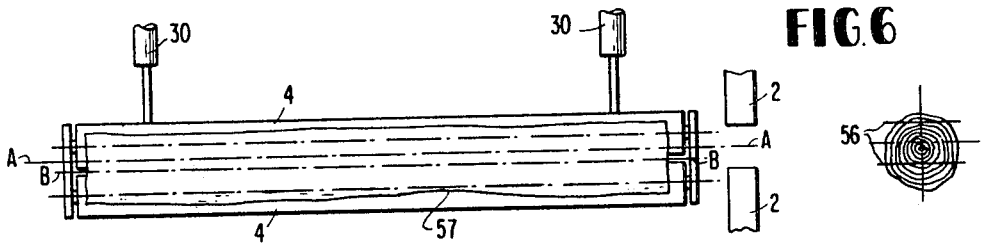
FIG. 6 shows the apparatus of FIGS. 1–4 arranged for offset sawing.
Figure 7:
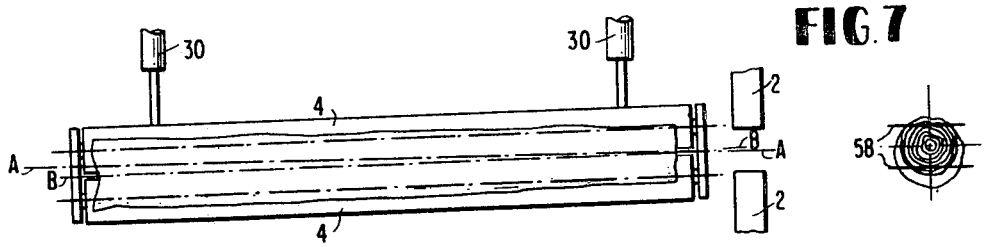
FIG. 7 shows the apparatus of FIGS. 1–4 set for taper sawing.

The sawing options available in the apparatus of FIGS. 1–4 are illustrated in FIGS. 5–7. In these drawings, A—A designates the machine axis which is parallel to the path of the log-engaging dogs and located in the central vertical longitudinal plane of the machine. The horizontal projection of the longitudinal center line of the log is represented at B—B.

FIG. 5 shows what is referred to as center sawing. The log axis is coincident with the machine axis, causing the saws 2 to make cuts along the lines 55, removing substantially equal slabs as illustrated in the end view of FIG. 5.

A log initially positioned as shown in FIG. 5 may be displaced laterally by actuation of the cylinders 30 to a position shown in FIG. 6 where it will be seen that the log axis B—B is laterally offset from the machine axis A—A. This mode of operation is referred to as offset sawing, the saw blades 2 making cuts along the lines 56 so that slabs of unequal sizes will result. Such a sawing option may be particularly desirable when one side of the log is recessed as at 57.

In lieu of or in addition to lateral shifting of the log axis, there are occasions when angular shifting is desirable, resulting in a mode of operation referred to herein as taper sawing. Again, the guide surfaces provided by the external surfaces of the turning rolls 4 are displaced by the cylinders 30. In this instance the displacement of the cylinders is unequal so that the log axis B—B is angularly displaced from the machine axis A—A. The saws then make the cuts as represented by the lines 58 in FIG. 7. In this mode of operation, the longitudinal axis of the log will be within about five degrees of the machine axis, such a condition being substantially parallel within the intended meaning of this specification.

When performing taper sawing in apparatus provided with turning rolls 4, forward portions of one of the turning rolls will lie in the path of a rear portion of the log. This may necessitate the provision of means for raising the log or lowering the turning rolls prior to the commencement of log movement along the machine axis.

Figure 8:
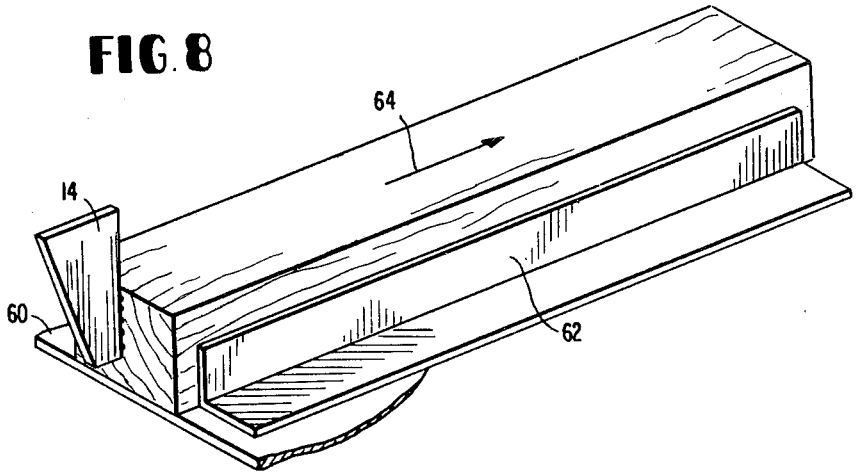
FIG. 8 shows an alternate log support means for processing logs which have previously been provided with adjacent perpendicular faces.

The turning rolls 4 are the preferred initial support for the logs, as they facilitate turning of a log and their external surfaces act as guides establishing an alignment with the log axis. However, other support means may be used. FIG. 8 shows an alternate support surface 60 provided with an angle which forms an upstanding fence 62 for indexing the log. In this case, the "log" has previously been processed to provide it with at least two adjacent perpendicular surfaces, one for lying on support 60 and the other for indexing against the fence 62. The pusher dog 14 then moves the log in the machine direction as represented by the arrow 64.

In the modified version of the apparatus shown in FIGS. 9–14, conventional chipper heads provide planar faces on one or more surfaces of the log prior to arrival of the log at the saws 2. To enable a chipper head to operate on the lower surface of the log, a retractible preliminary holdback dog engages the forward end of a log, imposing on the log a rearwardly-directed gripping force. The preliminary holdback dog moves with the log until the forward end of the log engages a holdback dog on a lower carrier chain, the latter being constructed essentially as in the embodiment of FIGS. 1–4.

The chain and pusher dog assembly of the embodiment of FIGS. 9–14 is substantially the same as that previously described in connection with FIGS. 1–4. So are the turning rolls. However, in the embodiment of FIGS. 9–14, chipper heads are provided for forming a horizontal chipped face on the bottom of the log and vertical chipped faces on the opposed sides of the log.

Figure 9:
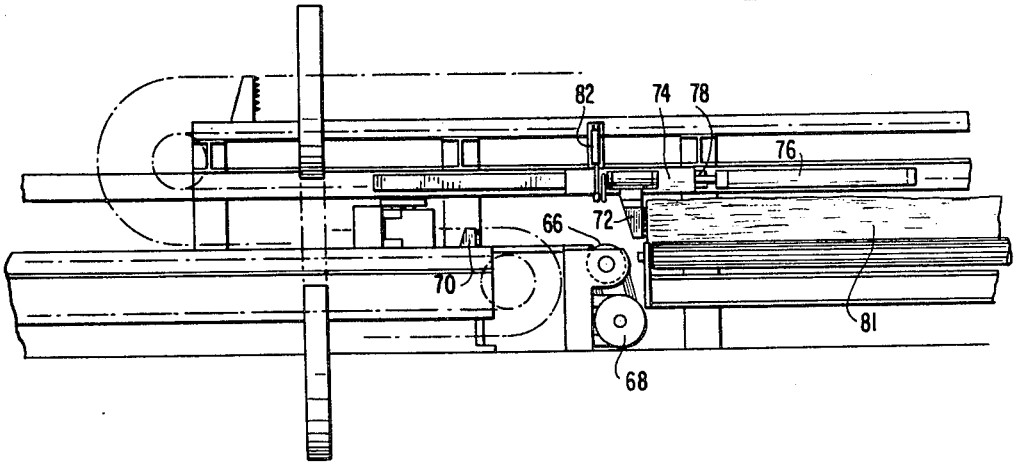
FIGS. 9–11 show sequential stages in the operation of a modified apparatus, in which a temporary retractible holdback dog engages the forward end of a log as the log is moved past a bottom-flattening chipper head.

Referring to FIG. 9, the bottom chipper head 66 is of conventional construction and is driven by a motor 68. The location of the chipper head 66 requires the foreshortening of the path of the lower carrier chain as described in connection with FIGS. 1–4. Accordingly, the forward end of a log must move through a distance before it arrives at the principal holdback dog 70 which lies in the path of the oncoming log.

Figure 10:
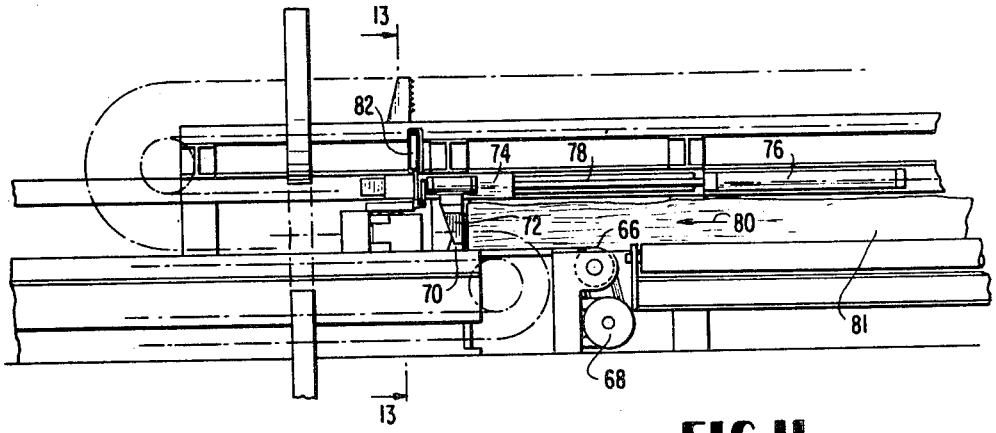

During the initial movement of the log by the pusher dog, the forward end of the log is engaged by a retractible holdback dog 72 positioned as shown in FIGS. 9, 10 and 13. The dog 72 is mounted on a carriage 74 connected to a hydraulic cylinder 76 and movable longitudinally on a trackway 78. Hydraulic fluid to the cylinder 76 is controlled so that the holdback dog 72 on carriage 74 resists forward movement along the machine axis as represented by the arrow 80. Thus, a rearwardly-directed gripping force will be exerted by the dog 72 on the forward end of the log 81 as the log is moved to the position illustrated in FIG. 10. During such movement, the bottom chipper head 66 forms a planar face on the undersurface of the log.

Figure 11:
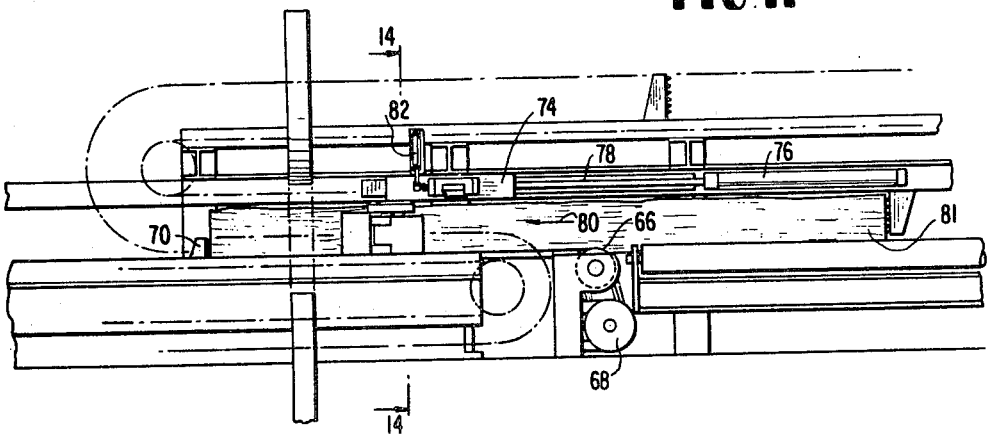

The log while at the FIG. 10 position has its forward end in a transfer area where engagement and retardation of the forward end of the log is transferred from the retractible dog 72 to the principal holdback dog 70. Retraction of dog 72 is accomplished by actuation of the cylinder 76 to move the carriage 74 forwardly on track 76, and swinging the retractible dog 72 to the side as shown in FIGS. 11 and 14, removing it from the path of the log. FIG. 14 shows the retractible dog 72 having been swung to the side by a pneumatic cylinder 82. The cylinder 82 has its upper end connected to the carriage 74 and its lower end connected pivotally at 84 to the arm which carries the retractible dog 72. While in this retracted position, the hydraulic cylinder 76 returns the carriage 74 to its rearward position illustrated in FIG. 9. After the log passes thereby, the retractible dog 72 is returned to its initial position as shown in FIG. 13, where it will be in the path of the next log passing through the system.

After the bottom of the log has been provided with a planar chipped face, and before the log is sawn, the sides of the log may be similarly chipped to provide vertical faces. Chipper heads for this purpose are shown at 86 in FIG. 12. Apparatus equipped with the side-flattening chipper heads 86 produces one heart cant and two sideboards. Such sideboards may be transferred either to the green chain or secondary breakdown machine; and, the center cant may be moved into position for breakdown by an edger or resaw. A center cant having a bottom flattened by the chipper head 66 possesses a guiding surface which allows more cutting options for processing the cant in a twin or quad linebar resaw.

This specification has disclosed only the preferred embodiments of the invention. Diverse machines embodying the principles disclosed herein are expected to be devised by persons working in the field, so it is emphasized that the invention is not limited only to the disclosed embodiments but is encompassing of a wide variety of apparatus possessing a structure or method of operation falling within the spirit of the claims which follow.

I claim:

1. A sawmill log handling system for advancing logs longitudinally along a given path from an infeed side of a saw, through the saw and to an outfeed side of the saw, said system comprising, a pusher member for engaging a rearward end of a log, first carrier means attached to and supporting said pusher member, rear drive means for moving said first carrier means to advance the pusher member along said given path to carry said log from said infeed side, through the saw and to said outfeed side, a holdback member for engaging a forward end of said log while said log is being moved by said rear drive means, second carrier means for supporting one or more of said holdback members for movement from an initial position at the infeed side of the saw to the outfeed side of the saw as said log is cut by the saw, resistance means for retarding movement of the holdback member as the log is advanced through the saw by the rear drive means, whereby the log is grasped between the driven pusher member and the retarded holdback member, and forward drive means for moving said second carrier means to bring a holdback member thereon to said initial position after a log is cut by the saw.

2. The sawmill log handling system of claim 1 wherein each of said carrier means includes an endless member movable in an endless path.

3. The sawmill log handling system of claim 2 wherein the said carrier means are on diametrically opposite sides of said given path of the log.

4. The sawmill log handling system of claim 2 having support means for supporting a log on the infeed side of the saw and enabling a log thereon to be moved laterally with respect to said given path.

5. The sawmill log handling system of any one of claims 1, 2, 3 or 4 in combination with a saw which has at least two spaced apart log-cutting blades, said pusher member and said holdback member being movable between said blades to carry a log therebetween.

6. A sawmill log handling system for advancing logs longitudinally along a given path from an infeed side of a saw, through the saw and to an outfeed side of the saw, said system comprising, a pusher member for engaging a rearward end of a log, first carrier means attached to and supporting said pusher member, rear drive means for moving said first carrier means to advance the pusher member along said given path to carry said log from said infeed side, through the saw and to said outfeed side, a holdback member for engaging a forward end of said log while said log is being moved by said rear drive means, second carrier means for supporting one or more of said holdback members for movement from an initial position at the infeed side of the saw to the outfeed side of the saw as said log is cut by the saw, resistance means for retarding movement of the holdback member as the log is advanced through the saw by the rear drive means, whereby the log is grasped between the driven pusher member and the retarded holdback member, and forward drive means for driving the holdback member forwardly away from the log after the log has passed through the saw.

7. The sawmill log handling system of claim 6 wherein each of said carrier means includes an endless member movable in an endless path.

8. The sawmill log handling system of claim 7 wherein the said carrier means are on diametrically opposite sides of said given path of the log.

9. The sawmill log handling system of claim 7 having support means for supporting a log on the infeed side of the saw and enabling a log thereon to be moved laterally with respect to said given path.

10. The sawmill log handling system of any one of claims 6, 7, 8 or 9 in combination with a saw which has at least two spaced apart log-cutting blades, said pusher member and said holdback member being movable between said blades to carry a log therebetween.

11. The sawmill log handling system of claim 1 or claim 6 including means located on said infeed side for positioning a log before it is grasped between the pusher and holdback members, and means located on said outfeed side for discharging log portions which arrive at the outfeed side.

12. The sawmill log handling system of claim 1 or claim 6 including chipper heads for forming chipped faces on the log.

13. The sawmill log handling system of claim 1 or claim 6 including a scanner system for determining a position to be occupied by a log before it is grasped between the pusher and holdback members.

* * * * *